US011228078B2

(12) United States Patent
Vook et al.

(10) Patent No.: US 11,228,078 B2
(45) Date of Patent: Jan. 18, 2022

(54) ELECTRICAL PLUG CONNECTOR

(71) Applicant: Keysight Technologies, Inc., Santa Rosa, CA (US)

(72) Inventors: Dieter W. Vook, Santa Clara, CA (US); Douglas Baney, Santa Clara, CA (US); Khouzema Unchwaniwala, Santa Rosa, CA (US); Matthew Richter, Santa Rosa, CA (US)

(73) Assignee: Keysight Technologies, Inc., Santa Rosa, CA (US)

( * ) Notice: Subject to any disclaimer, the term of this patent is extended or adjusted under 35 U.S.C. 154(b) by 0 days.

(21) Appl. No.: 16/641,691

(22) PCT Filed: Nov. 22, 2017

(86) PCT No.: PCT/US2017/062960
§ 371 (c)(1),
(2) Date: Feb. 25, 2020

(87) PCT Pub. No.: WO2019/103734
PCT Pub. Date: May 31, 2019

(65) Prior Publication Data

US 2020/0280118 A1 Sep. 3, 2020

(51) Int. Cl.
*H01P 5/08* (2006.01)
*H01P 3/02* (2006.01)
(Continued)

(52) U.S. Cl.
CPC ..... *H01P 5/085* (2013.01); *H01P 3/026* (2013.01); *H01P 3/06* (2013.01); *H01R 24/52* (2013.01); *H01R 2103/00* (2013.01)

(58) Field of Classification Search
CPC . H01P 5/085; H01P 3/026; H01P 3/06; H01R 24/52
See application file for complete search history.

(56) References Cited

U.S. PATENT DOCUMENTS 3,544,928 A * 12/1970 Keiter ..... H01B 11/1834 333/245
5,007,843 A 4/1991 Smolley
(Continued)

FOREIGN PATENT DOCUMENTS

| | | | |
|---|---|---|---|
| JP | 2007323865 | A | 2/2007 |
| JP | 2011171405 | A | 9/2011 |
| WO | 2019074470 | A1 | 4/2019 |

OTHER PUBLICATIONS https://www.microwaves101.com/encyclopedias/coax-cutoff-frequency, microwaves101.com website, accessed Mar. 11, 2021. (Year: 2021).*

(Continued)

*Primary Examiner* — Samuel S Outten

(57) ABSTRACT

An apparatus includes an electrical connector. The electrical connector is configured to electrically couple a signal transmission line to another signal transmission line. The electrical connector includes a first electrical conductor and a second electrical conductor. The first electrical conductor is disposed around a center axis. The first electrical conductor is disposed azimuthally symmetric around the center axis. The second electrical conductor is disposed around the center axis and around the first electrical conductor. The second electrical conductor is disposed azimuthally symmetric around the center axis. Faces on opposing ends of the electrical connector along the center axis are configured to mate the signal transmission line and the second electrical conductor in a first plane and the other signal transmission line and the second electrical conductor in a second plane.

17 Claims, 12 Drawing Sheets

(51) Int. Cl.

| | |
|---|---|
| ***H01P 3/06*** | (2006.01) |
| ***H01R 24/52*** | (2011.01) |
| ***H01R 103/00*** | (2006.01) |

(56) References Cited

U.S. PATENT DOCUMENTS

| | | | | |
|---|---|---|---|---|
| 6,039,580 | A | 3/2000 | Sciarretta et al. | |
| 8,923,776 | B1 | 12/2014 | Nelson | |
| 10,109,904 | B2 | 10/2018 | Lee et al. | |
| 2003/0020560 | A1 | 1/2003 | Marsh | |
| 2008/0048882 | A1 | 2/2008 | Paugh et al. | |
| 2015/0137912 | A1* | 5/2015 | Nagel ..... | H01P 1/045 333/238 |
| 2017/0047633 | A1 | 2/2017 | Lee et al. | |

OTHER PUBLICATIONS

International Search Report for PCT/US2017/062960 dated Aug. 22, 2018, 12 pgs.

"Micro-Coax, Microwave & RF cable catalog," http://micro-coax.com/wp-contenUthemes/micro coaxlincludes/pdf/13-MIC-0006. SemiRigid Brochure FINAL Web.pdf, pp. 1-56.

* cited by examiner

ELECTRICAL PLUG CONNECTOR

CROSS-REFERENCE TO RELATED APPLICATIONS

The present application is the U.S. National Phase application under 35 U.S.C. § 371 of, and claims priority from, International Application No. PCT/US2017/062960, filed on Nov. 22, 2017, published as WO2019103734A1 on May 31, 2019. The entire disclosures of these applications are specifically incorporated herein by reference.

BACKGROUND

There are three main methods used for transmitting at frequencies above 50 GHz. A first method is the transmission of radiation into the air. Known antennas can radiate signals into the air, but are problematic in terms of efficiency, directionality and cross talk. A second method is the transmission by waveguides (signal transmission lines). Known waveguides include metal enclosures, which isolate radio frequency (RF) signals within the waveguide from RF signals from without. However, known waveguides are often unsuitable for most applications above a cut-off frequency for the first higher order mode, and are suitable to operate in the single lowest order mode over approximately a frequency ratio of 1.5 between the lowest frequency and highest frequency. A third method for transmitting signals at high frequencies is transmission over known coaxial transmission lines, sometimes referred to as coaxial cables. Known coaxial cables are cables with an inner signal conductor disposed around a center axis, an outer ground conductor disposed concentrically around the inner signal conductor and the center axis, and a dielectric material disposed between the inner signal conductor and the outer ground conductor. Coaxial cables are problematic in terms of efficiency compared to waveguides. Frequencies up to 110 gigahertz (GHz) are used for commercial applications, but difficulties are still encountered in implementing commercial applications with comparatively high frequencies (e.g., 110 GHz), such as for high data rates. At such high frequencies, signal transmission cables or electrical connectors of a particular diameter propagate a higher order mode that causes interference with a primary mode.

Devices for effecting electromagnetic signal transmission, such as known coaxial cables and known waveguides, sometimes need to be connected to one another. For example, radio frequency (RF) signals from waveguides in RF enclosures are sometimes coupled to coaxial cables outside of the RF enclosures. Signals at or below 110 GHz can be brought out of known waveguides in RF enclosures with the known coaxial connectors such as the commonly used 1 mm connector. Such known coaxial connectors are comparatively expensive, are generally limited to frequencies at or below 110 GHz, and are fragile. A conventional coaxial connector with a 1 mm diameter in use since 1989 may be referred to as a 1 mm connector, and has a sub 1/10 mm center pin and even thinner and smaller fingers that capture the center pin. Therefore, the 1 mm connector is fragile due to the tolerance and precision required for a good connection, and can be easily bent out of position. There is no standard way in industry to bring signals above 110 GHz out of RF enclosures, and attempts to implement coaxial connectors for high frequencies have mainly concentrated on reducing the diameters of such coaxial connectors below 1 mm. Due to the fragility and cost, no rugged, standard coaxial connectors for signals above 110 GHz are in widespread use.

What is needed, therefore, is an apparatus for transmitting electromagnetic signals that overcomes at least the shortcoming of the known structures discussed above.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

Figure 1A:
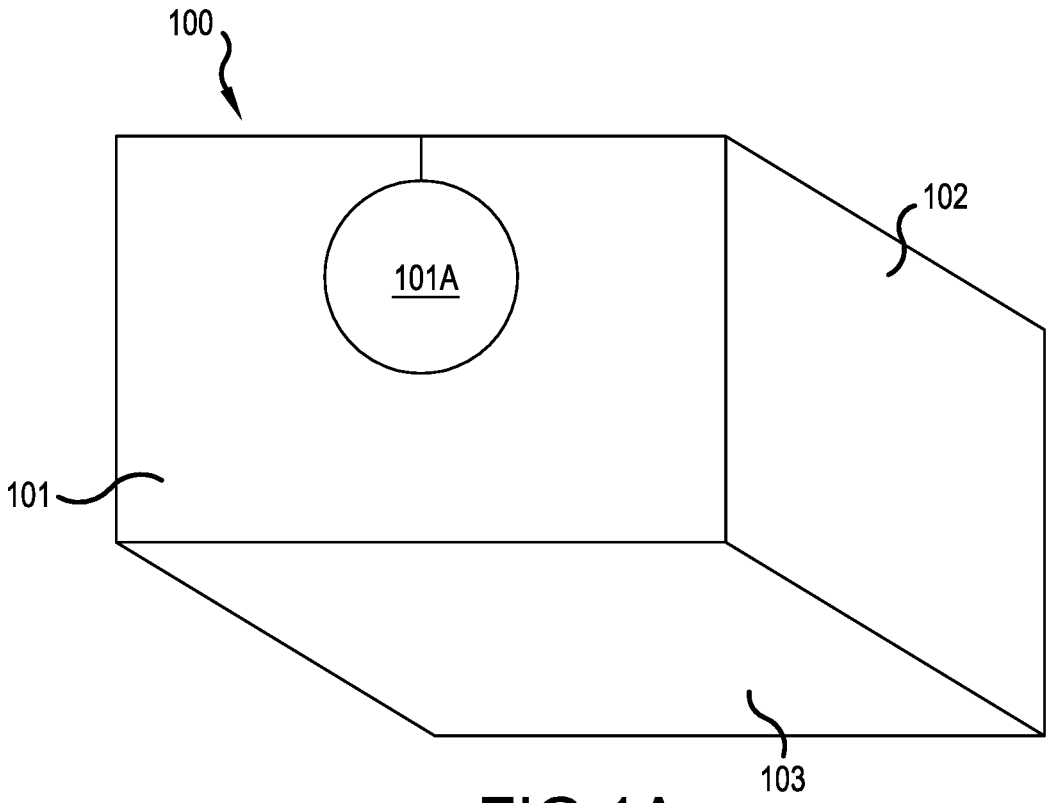
FIG. 1A is an illustrative perspective view of an enclosure with an opening, in accordance with a representative embodiment.

In the following detailed description, for purposes of explanation and not limitation, representative embodiments disclosing specific details are set forth in order to provide a thorough understanding of an embodiment according to the present teachings. Descriptions of known systems, devices, materials, methods of operation and methods of manufacture may be omitted so as to avoid obscuring the description of the representative embodiments. Nonetheless, systems, devices, materials and methods that are within the purview of one of ordinary skill in the art are within the scope of the present teachings and may be used in accordance with the representative embodiments. It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

It will be understood that, although the terms first, second, third etc. may be used herein to describe various elements or components, these elements or components should not be limited by these terms. These terms are only used to distinguish one element or component from another element or component. Thus, a first element or component discussed below could be termed a second element or component without departing from the teachings of the present disclosure.

The terminology used herein is for purposes of describing particular embodiments only, and is not intended to be limiting. As used in the specification and appended claims, the singular forms of terms 'a', 'an' and 'the' are intended to include both singular and plural forms, unless the context clearly dictates otherwise. Additionally, the terms "comprises", and/or "comprising," and/or similar terms when used in this specification, specify the presence of stated features, elements, and/or components, but do not preclude the presence or addition of one or more other features, elements, components, and/or groups thereof. As used herein, the term "and/or" includes any and all combinations of one or more of the associated listed items.

Unless otherwise noted, when an element or component is said to be "connected to", "coupled to", or "adjacent to" another element or component, it will be understood that the element or component can be directly connected or coupled to the other element or component, or intervening elements or components may be present. That is, these and similar terms encompass cases where one or more intermediate elements or components may be employed to connect two elements or components. However, when an element or component is said to be "directly connected" to another element or component, this encompasses only cases where the two elements or components are connected to each other without any intermediate or intervening elements or components.

In view of the foregoing, the present disclosure, through one or more of its various aspects, representative embodiments and/or specific features or sub-components, is thus intended to bring out one or more of the advantages as specifically noted below. For purposes of explanation and not limitation, example embodiments disclosing specific details are set forth in order to provide a thorough understanding of an embodiment according to the present teachings. However, other embodiments consistent with the present disclosure that depart from specific details disclosed herein remain within the scope of the appended claims. Moreover, descriptions of well-known apparatuses and methods may be omitted so as to not obscure the description of the example embodiments. Such methods and apparatuses are within the scope of the present disclosure.

As described herein, coaxial plug connectors are electrical connectors that can be provided with planar or substantially planar faces for mating with signal transmission lines. In this context, and in addition to their descriptions below, planar, or substantially planar may be taken to mean that the width of overlap between the coaxial plug connector and a signal transmission line in a plane is minimal compared to the width of coaxial plug connectors. For example, the width of overlap may be less than 10% of the width of the coaxial plug connectors, less than 5% of the width of the coaxial plug connectors, less than 2% of the width of the coaxial plug connectors, or less than 1% of the width of the coaxial plug connectors. Thus, as the width of overlap approaches zero (0), an interface between the coaxial plug connectors and the signal transmission lines is either planar or substantially planar.

FIG. 1A is an illustrative perspective view of an enclosure with an opening, in accordance with a representative embodiment.

In FIG. 1A, an enclosure 100 includes a front face 101, a side face 102, a bottom face 103, a top face (not labeled or shown) and an opening 101A on the front face 101. The front face 101 has an upper edge, a lower edge, and two side edges. The top face (not labeled or shown) is a roof connected to the upper edge of the front face 101. The bottom face 103 is a floor connected to the lower edge of the front face 101. In FIG. 1A each of the front face 101, the side face 102, the bottom face 103 and the top face have four edges, but this is not an absolute requirement and any or all of the front face 101, the side face 102, the bottom face 103 and the top face may have more or fewer edges. Notably, the enclosure 100 may be metal such that all edges are electrically conductive, and connect electrically.

The enclosure 100 may be a radio frequency (RF) enclosure. An RF enclosure is generally a metal housing that isolates RF signals within the RF enclosure and that isolates RF signals outside the RF enclosure. The enclosure 100 may be in the shape of a box such that the front face 101 is in a first plane, the side face 102 is in a second plane perpendicular or substantially perpendicular (e.g., within 10 degrees) to the first plane, and the bottom face 103 is in a third plane perpendicular or substantially perpendicular (e.g., within 10 degrees) to both the first plane and the second plane. The enclosure 100 encloses a signal transmission line and isolates the signal transmission line from another signal transmission line outside of the enclosure 100 and from radio frequency signals from the other signal transmission line. An electrical plug connector is configured to be fixed in the opening 101A to electrically couple the signal transmission line in the enclosure 100 to the other signal transmission line outside of the enclosure 100. While the electrical plug connector can be fixed in place in the opening 101A, the electrical plug connector can also be removed and replaced as described herein. Although the enclosure 100 is described as a "box" above, many types of sealed metal enclosures are contemplated for the enclosure 100, and the restriction of orthogonal walls may be relaxed. As such, the shape of the enclosure 100 depicted is merely illustrative, and other shapes are contemplated. For example, in alternative embodiments, the enclosure 100 could be cylindrical or spherical.

Figure 1B:
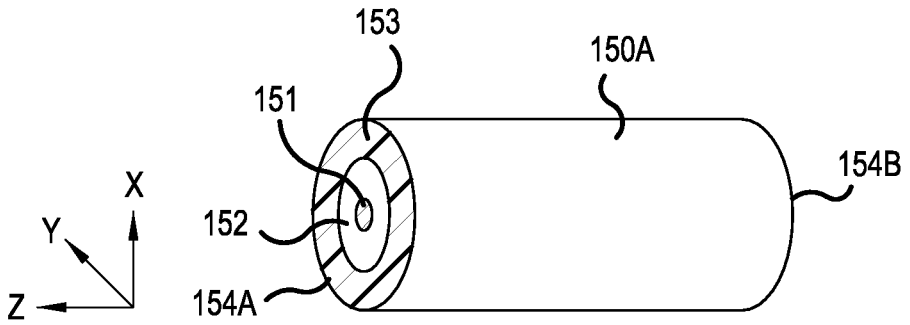
FIG. 1B is an illustrative perspective view of an electrical plug connector, in accordance with a representative embodiment.

FIG. 1B is an illustrative perspective view of an electrical plug connector, in accordance with a representative embodiment.

In FIG. 1B, the electrical plug connector 150A comprises an inner electrical conductor 151, an outer electrical conductor 153, and a dielectric layer 152 disposed therebetween. The electrical plug connector 150A also comprises a first outer connector plane 154A disposed in the x-y plane of the coordinate system depicted. In FIG. 1B, the inner electrical conductor 151 and outer electrical conductor 153 are shown on a face of the electrical plug connector 150A in the first outer connector plane 154A. To be clear, the first outer connector plane 154A is representative of a planar surface in which and by which the electrical plug connector 150A mates a signal transmission line.

Notably, the electrical plug connector 150A is illustratively coaxial about a center axis that runs in a direction parallel to the z-axis of the coordinate system of FIG. 1B, and through the center of the inner electrical conductor 151 and the outer electrical conductor 152A. In a representative embodiment, the inner electrical conductor 151 may be azimuthally symmetric or substantially azimuthally symmetric (e.g., >90% azimuthally symmetric) around the center axis, and the outer electrical conductor 152A may be azimuthally symmetric or substantially azimuthally symmetric (e.g., >90% azimuthally symmetric) around the center axis.

As noted, the first outer connector plane 154A in FIG. 1B is representative of a face on one end of the electrical plug connector 150A. Another face on an opposite end of the electrical plug connector 150A is a second outer connector plane 154B, which is substantially identical in planarity (i.e., degree of flatness) as the first outer connector plane 154A, and is disposed in the x-y plane of FIG. 1B. The face in the outer first and second connector planes 154A, 154B is configured to mate the electrical plug connector 150A to the signal transmission line (not shown in FIG. 1B). The opposing second outer connector plane 154B of the electrical plug connector 150A is configured to mate the electrical plug connector 150A to another signal transmission line. In an embodiment, the first and second outer connector planes 154A, 154B may mate the signal transmission line(s) via the outer electrical conductor 152A but not via the inner electrical conductor 151 or via the dielectric.

Although not shown in FIG. 1B, an outer enclosure may be provided around the outer electrical conductor 153. The outer enclosure may enclose a coaxial cable that includes the inner electrical conductor 151 and the outer electrical conductor 153. Additionally, in embodiments explained later, an electrically thin resistive layer is added to a coaxial cable or electrical plug connector 150A between the inner electrical conductor 151 and the outer electrical conductor 153.

An example of the face in the outer connector plane 154 is a planar or substantially planar face. The planarity of the face may be measured relative to the overall width of the electrical plug connector 150A, so that the width of overlap where mating occurs between the electrical plug connector 150A and a signal transmission line is minimal compared to the width of the electrical plug connector 150A. By way of explanation, an electrical plug connector 150A can be provided with a surface suitable for mating in a plane so as to provide a robust RF connection.

In a representative embodiment, the electrical plug connector 150A can be inserted into a machined metal sleeve (not shown) and secured in place, such as by soldering, with a set screw, or with a compression fitting. The coaxial cable (not shown) to be connected to the electrical plug connector 150A can be cut and polished to provide a suitably planar mating surface to mate with the outer connector plane 154 of the electrical plug connector 150A. In accordance with a representative embodiment, "a suitably planar" mating surface means the surface roughness of the outer connector plane 154 should be better than approximately $1150^{th}$ of the wavelength of the RF energy transmitted by the electrical plug connector 150A. Just by way of example, at 100 GHz, the wavelength of RF energy is approximately 3 mm. In this case, the surface roughness should be approximately less than approximately 60 μm.

The coaxial cable may then have soft gold (Au) electrodeposited (typically ~10 um) on the metallic end surfaces. The length of the mechanical metal sleeve may be ten to twenty times the diameter of the electrical plug connector 150A. For a 0.020" diameter coaxial cable, the electrical plug connector 150A could be between 5 mm and 1 cm long. The mechanical metal sleeve can then be mounted within another sleeve that is machined to provide mechanical stops for the electrical plug connector 150A.

In another representative embodiment, a coaxial cable may be inserted through and past an end of a metal ferrule (not shown) and then secured, such as by soldering, with a set screw or with a crimp. The end of the coaxial cable can then be cut and polished back to the end of the metal ferrule. The outer housing of the metal ferrule can be prepared with a spring-loaded section to tension the combined coaxial cables and the electrical plug connector 150A together with a set compression force. The diameter of the metal ferrule is designed with tolerance to prevent non-axial forces on the interface between the combined coaxial cables and the electrical plug connector 150A. Low cost versions can be fabricated with just compression clips, while high performance versions can be fabricated with threaded connections between the plug and the cable-end hardware.

Figure 1C:
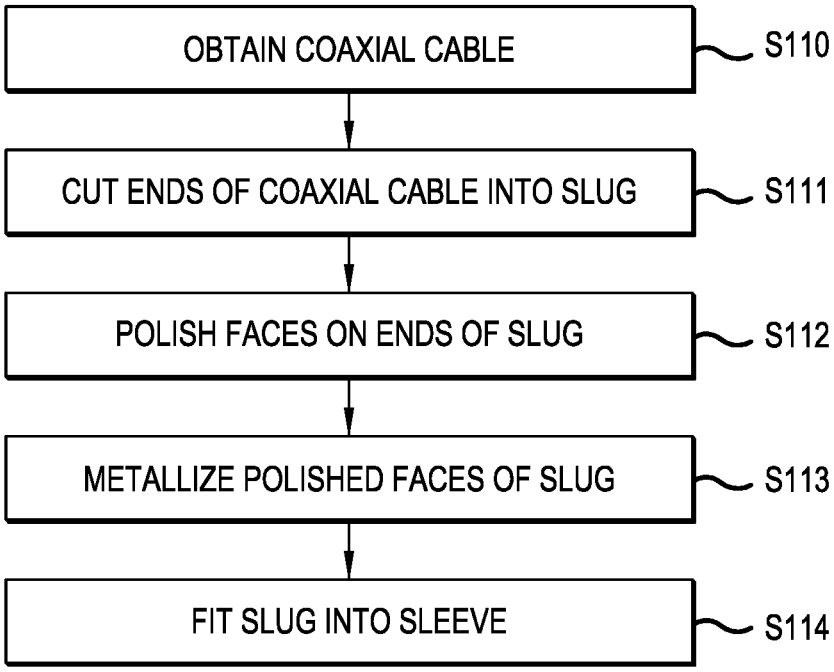
FIG. 1C is an illustrative method of manufacturing an electrical plug connector, in accordance with a representative embodiment.

FIG. 1C is an illustrative method of manufacturing an electrical plug connector, in accordance with a representative embodiment. The method of manufacturing the planar face may start with obtaining a piece of coaxial cable at S110. At S111, ends of the coaxial cable are cut into a slug. The slug made from the coaxial cable is the basis of the electrical plug connector 150A in the embodiment of FIG. 1C. At S112, faces on the end of the slug are polished. At S113, the polished faces of the slug are metallized, such as by depositing gold or another soft metal on the polished faces at the inner electrical conductor 151 and the outer electrical conductor 153, but not at the dielectric layer(s). At S114, the slug is fit into a sleeve. The sleeve may have an exact dimension to fit into the opening 101A in FIG. 1A and to fit around the outer layer of the electrical plug connector 150A in FIG. 1B.

Figure 2A:
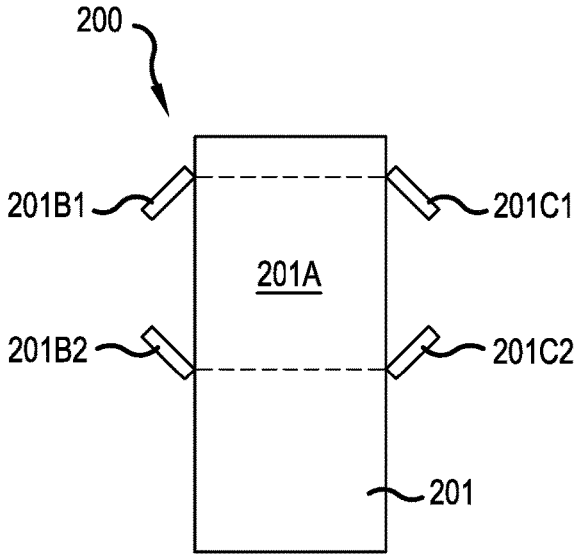
FIG. 2A is an illustrative profile view of an enclosure with an opening, in accordance with a representative embodiment.

FIG. 2A is an illustrative profile view of an enclosure with an opening, in accordance with a representative embodiment.

In FIG. 2A, the enclosure 200 includes opening 201A that passes entirely therethrough from one side to the opposing side. The opening 201A includes a central axis. The side face 201 of the enclosure 200 corresponds to the side face 102 in FIG. 1A. The side face 201 may be in or substantially in (e.g., >90%) a plane that runs parallel to the central axis of the opening 201A.

In FIG. 2A, biasing member 201B1 and biasing member 201B2 are on one side of the enclosure 200. The biasing member 201B1 is on the top of the opening 201A. The biasing member 201B2 is on the bottom of the opening 201A. The biasing member 201B1 and the biasing member 201B2 are on opposite sides of the opening 201A, and are used to fasten an electrical plug connector 150A as in FIG. 1B in place in the opening 201A. Biasing member 201C1 and biasing member 201C2 are on another side of the enclosure 200, opposite the biasing member 201B1 and the biasing member 201B2. The biasing member 201C1 is on the top of the opening 201A. The biasing member 201C2 is on the bottom of the opening 201A. The biasing member 201C1 and the biasing member 201C2 are on opposite sides of the opening 201A, and are also used to fasten an electrical plug connector 150A as in FIG. 1B in place in the opening 201A. The electrical plug connector 150A can be released by loosening the biasing member 201B1, the biasing member 201B2, the biasing member 201C1 and the biasing member 201C2 away from the center axis of the opening 101A.

Although the face of the electrical plug connector 150A is described as planar above, the face may also be rounded. The references to planes for mating as used herein primarily refer to the absence of a standard male/female connection. For a rounded face, a limited portion (e.g., the inner electrical conductor 151 and the outer electrical conductor 152A, but not an intervening insulating dielectric layer) of the electrical plug connector 150A may then touch a corresponding inner conductor, and outer conductor of a coaxial cable or waveguide. In the embodiments described herein, both the inner electrical conductor 151 and the outer electrical conductor 152A are electrically connected.

Figure 2B:
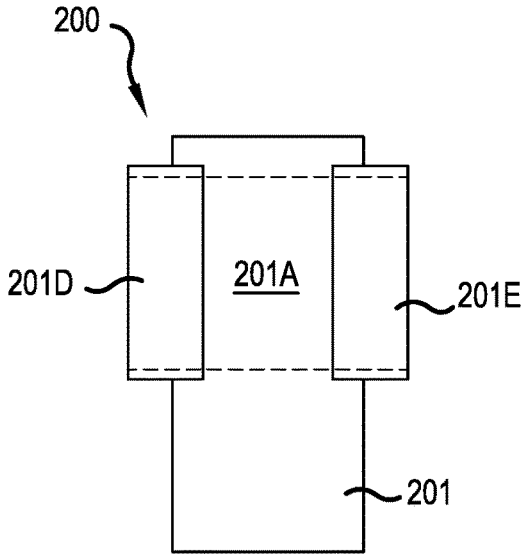
FIG. 2B is an illustrative profile view of another enclosure with an opening, in accordance with a representative embodiment.

FIG. 2B is an illustrative profile view of another enclosure with an opening, in accordance with a representative embodiment.

In FIG. 2B, fastening member 201D and fastening member 201E are provided on opposite sides of the opening 201A of the enclosure 200. The fastening member 201D and fastening member 201E may be annular, and may include a component that closes in towards the center axis of the opening 201A when the fastening member 201D and fastening member 201E are twisted about the center axis of the opening 201A. The fastening member 201D and fastening member 201E are used to fasten an electrical plug connector 150A as in FIG. 1B in place in the opening 201A. The electrical plug connector 150A can be loosened and released by twisting the fastening member 201D and fastening member 201E in an opposite direction compared to the direction used to fasten the electrical plug connector 150A in place.

Figure 2C:
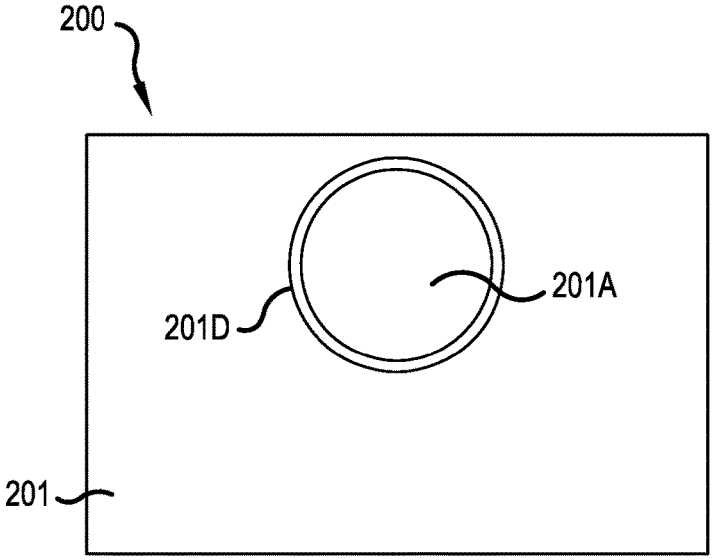
FIG. 2C is an illustrative frontal view of an enclosure with an opening, in accordance with a representative embodiment.

FIG. 2C is an illustrative frontal view of an enclosure with an opening, in accordance with a representative embodiment.

In FIG. 2C, the side face 201 is the front face of the same enclosure 200 as in FIG. 2B. The fastening member 201D is outlined by two circles, an inner circle and an outer circle, about the center axis that runs through the opening 201A. As noted with respect to FIG. 2B, rotating the fastening member 201D in one direction may result in a component tightening towards the center axis in order to secure an electrical plug connector 150A in place, and rotating the fastening member 201D in another direction may result in the component loosening away from the center axis in order to release the electrical plug connector 150A.

Figure 2D:
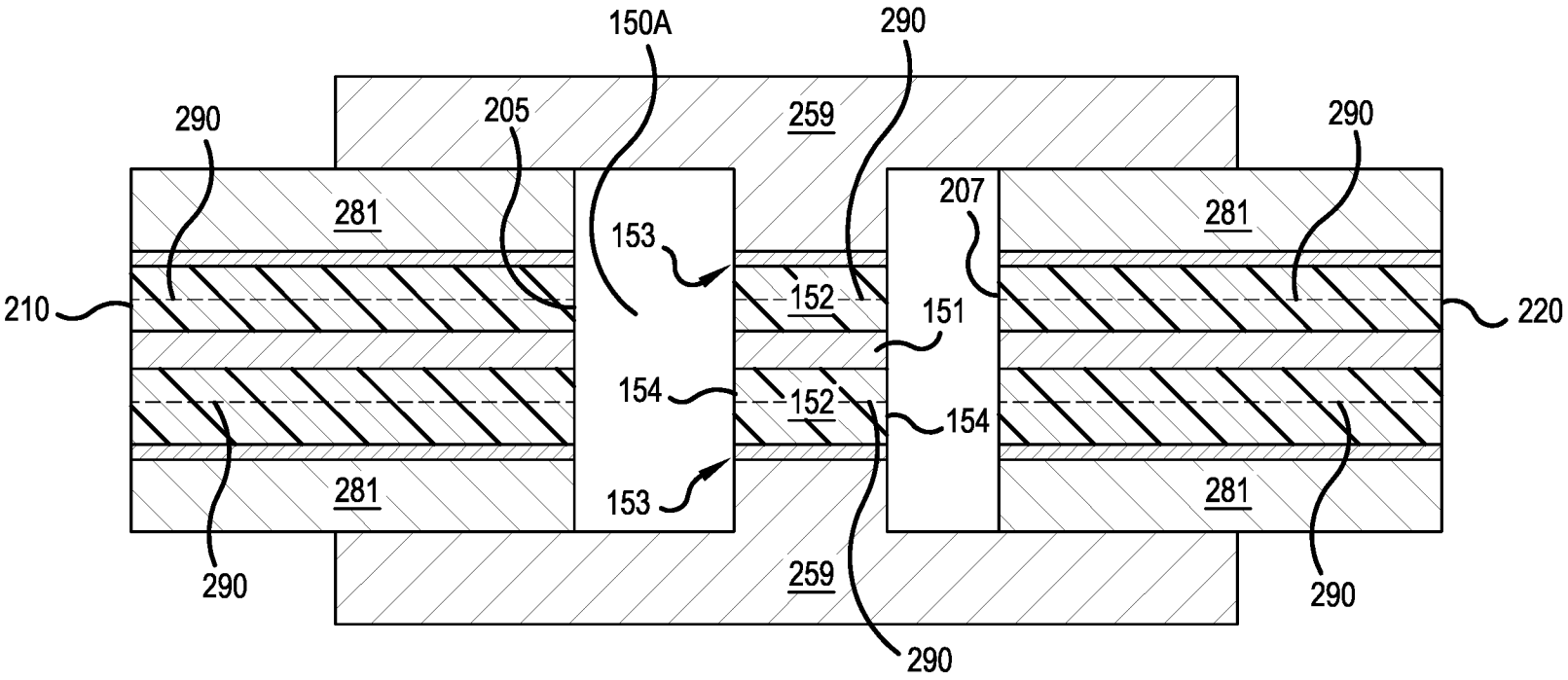
FIG. 2D is an illustrative profile view of another electrical plug connector, in accordance with a representative embodiment.

FIG. 2D is an illustrative profile view of another electrical plug connector, in accordance with a representative embodiment.

In FIG. 2D, a housing 259 houses the electrical plug connector 150A in the middle between first coaxial cable 210 and second coaxial cable 220. The housing 259 may be a machined metal sleeve that secures both the electrical plug connector 150A and the first and second coaxial cables 210, 220 in place. The electrical plug connector 150A and the first and second coaxial cables 210, 220 may be secured in place by soldering, with a set screw, with a clamp, or with a compression fitting. The first and second coaxial cables 210, 220 can be cut and polished to have planar or substantially planar first end face 205 and planar or substantially planar second end face 207, respectively, that match the substantially planar outer connector planes 154 of the electrical plug connector 150A. Metal end surfaces of the electrical plug connector 150A can have soft gold (Au) electro-deposited thereon at a depth of approximately 10 micrometers (um). Other soft conductors may be used as alternatives to gold. The length of the housing 259 may be on the order of ten or even twenty times the diameter of the cable. For a 0.020" coaxial cable, the electrical plug connector 150A may be approximately 5 mm to approximately 1 cm long (x-dimension in the coordinate system of FIG. 1B). The dielectric layer 152 provided between the inner electrical conductor 151 and the outer electrical conductor 153 may be PTFE, which may be the same dielectric in the coaxial cables to the left and right.

The first and second coaxial cables 210, 220 may be inserted through and past the ends of ferrules 281 that are metal, and then secured in place by soldering, with a set screw, or with a crimp. The ends of the first and second coaxial cables 210, 220 can be cut and polished back to the end of the ferrules 281 to form the first and second end faces 205, 207. The outer housing of the ferrules 281 can be prepared with a spring-loaded section to tension the combined coaxial cables and electrical plug connector 150A with a set compression force. The ferrules 281 can be designed with tolerances to prevent non-axial forces on the interface between the combined coaxial cables and electrical plug connector 150A.

Soft gold can be used to extend the electrical plug connector 150A at, for instance the inner electrical conductor 151 and the outer electrical conductor 153. The housing 259 may be used then to guide the electrical plug connector 150A and the coaxial cables and ferrules 281 on each side together. Once connected, the outer connector planes 154 are substantially flush with respective first and second end faces 205, 207 of the first and second coaxial cables 210, 220. As such very little space will be left between the electrical plug connector 150A in the middle and the coaxial cables and ferrules 281 on each side.

In an embodiment, a perforated sheet (not shown) may be used as an intermediary between the electrical plug connector 150A and the respective first and second end faces 205, 207 of the first and second coaxial cables 210, 220. For instance, a sheet of polymer such as rexolite can be perforated to reduce the effective dielectric constant, and then affixed to the outer connector plane 154 shown in FIG. 1A. Alternatively, an air gap may be provided between the electrical plug connector 150A and the respective first and second end faces 205, 207 of the first and second coaxial cables 210, 220. An air gap between the outer connector planes 154 and the respective first and second end faces 205, 207 of the first and second coaxial cables 210, 220 may be on the order of 10 milli-inches (250 μm). With a perforated sheet or an air gap, the inner electrical conductor 151 and the outer electrical conductor 152A still physically connect with the corresponding center conductor and outer conductor of a coaxial cable or waveguide so that the perforated sheet or air gap is between the insulating dielectrics.

In another representative embodiment, a retaining nut or a clamp (not shown) may be used to pressure the housing 159 to the electrical plug connector 150A.

The electrical plug connector 150A as in FIG. 2D could be provided between two coaxial cables of the same size. Alternatively, the electrical plug connector 150A as in FIG. 2D can be provided between two coaxial cables with smaller diameters by adding tapered end pieces to the electrical plug connector 150A, i.e., leading to the same diameter center conductor and outer electrical conductor 152A as in the electrical plug connector 150A.

In accordance with a representative embodiment, an electrically thin resistive layer 290 may be provided in the respective dielectric layers of the first and second coaxial cables 210, 220, and in the dielectric layer of the electrical plug connector 150A. Alternatively, the electrically thin resistive layer 290 may be provided only in the dielectric layer of the electrical plug connector 150A, or in one or both of the respective dielectric layers of the first and second coaxial cables 210, 220. Use of an electrically thin resistive layer is described below in connection with other representative embodiments. Use of the electrically thin resistive layer enables larger sizes for the electrical plug connector 150A with higher frequencies. For example, the electrically thin resistive layer may enable 220 GHz operation for a modified standard 047 cable with an outer cross-sectional diameter of 1.194 mm, which means such a cable operates in TEM mode without higher order modes for frequencies up to 220 GHz. The benefits from the larger size can result in more robust connectors that are less impacted by dust or particles, and less easily bent plugs. Larger connectors are also easier to see and harder to lose. Electrically thin resistive layers are described in the following commonly assigned patent applications, the disclosures of which are hereby incorporated by reference in their entireties: International Application Publication No. WO2017027109A1, filed Jun. 26, 2016 and entitled "Electrical Connectors for Coaxial Transmission Lines Including Taper and Electrically Thin Resistive Layer"; U.S. Patent Application Publication No. 20170047633, filed Jan. 27, 2016 and entitled "Signal Transmission Line and Electrical Connector Including Electrically Thin Resistive Layer and Associated Methods", and U.S. Pat. No. 10,109,904, filed Aug. 11, 2015 and entitled "Coaxial Transmission Line Including Electrically Thin Resistive Layer and Associated Methods."

A plug connector with an electrically thin resistive layer as described herein can be constructed from coaxial cable that already includes the electrically thin resistive layer. The coaxial cable is semi-rigid and built with a radially symmetric electrically thin resistive layer formed of a sheet part way between the center conductor and the outer conductor. The cable can be built by extruding PTFE over a center conductor, then wrapping that assembly with an electrically thin resistive sheet, and then extruding or folding an outer PTFE dielectric over the assembly, and then drawing an outer conductor over to a precise diameter to meet the impedance (50 Ohm) target. Once the semi-rigid coaxial cable is obtained, the plug can be obtained by epoxying or soldering the cable into a cylindrical sleeve, machining the assembly in a lathe to make it planar, and then electroplating the plug ends to add a layer of soft conductor to the ends. The soft conductor may be gold. Processes for manufacturing a coaxial cable, including coaxial cables with electrically thin resistive layers, are described in the following commonly assigned patent application, the disclosure of which is hereby incorporated by reference in its entireties: International Application No. PCT/US2017/055712, filed Oct. 9, 2017 and entitled "Hybrid Coaxial Cable Fabrication".

Cones for tapered ends of a coaxial connector can be machined from brass or beryllium copper and then gold plated. Conical dielectrics can be molded from PTFE or FEP. The tapered ends for the coaxial connector can be prepared to leave the inner electrical conductor 151 exposed. The inner electrical conductor 151 of the tapered section can have a recess (cup). An outer barrel can be attached to the outer conductor of the cable. The outer half of the dielectric cones can be dropped into the outer barrel on the cable. Then the sheet of electrically thin resistive layer on PTFE can be laid into the PTFE cone and an inner PTFE cone put in place, and the electrically thin resistive sheet trimmed to size. The inner conductor of the cones is then soldered onto the end of the cable, holding the entire assembly in place. The end of the coaxial cable can be machined planar and electroplated with gold.

Figure 3A:
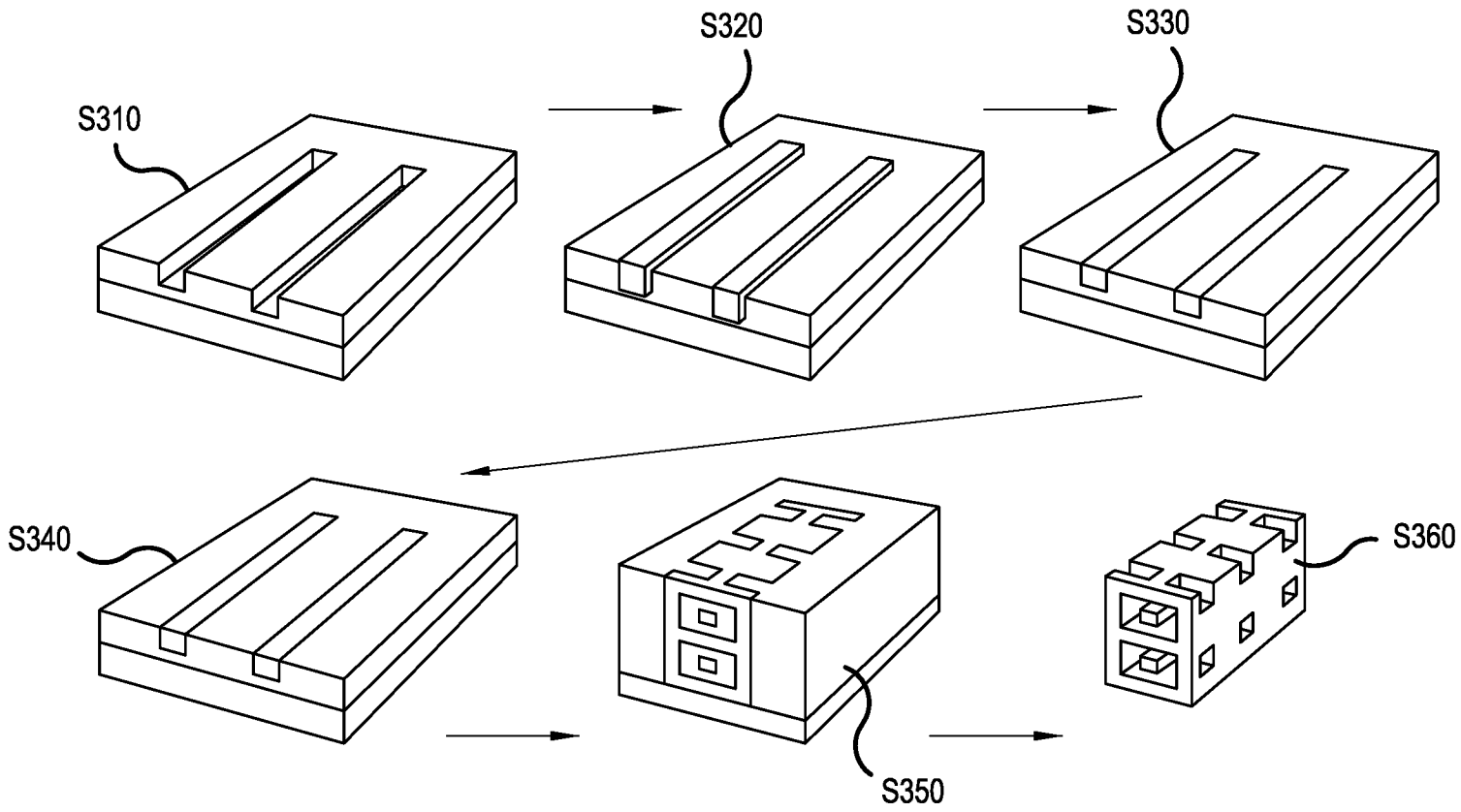
FIG. 3A is an illustrative view of a manufacturing progression, in accordance with a representative embodiment.

FIG. 3A is an illustrative view of a manufacturing progression, in accordance with a representative embodiment.

In FIG. 3A, a manufacturing progression is shown for making a mechanically robust RF connector for frequencies above 110 gigahertz (GHz). The connector made by the manufacturing progression in FIG. 3A may be a coaxial connector. The coaxial connector can interpose between a signal transmission line and another signal transmission line. The coaxial connector may have planar faces that mate with planar faces of the signal transmission line and the other signal transmission line. The planar faces may be metal, and a compliant conductive material can be applied to the mating metal faces. A fixture or fixtures as detailed in FIGS. 2A, 2B, 2C and/or 2D can be used to hold the coaxial connector in place in an opening 101A with the signal transmission line mated to one planar face and the other signal transmission line mated to an opposing planar face. The manufacturing progression of FIG. 3A may be used to make a plug connector that is an alternative to a plug connector made using commercially available coaxial cables.

In FIG. 3A, the manufacturing progression starts with a bare wafer and a patterned photoresist or wet etchable sacrificial layer at S310. Alternatively, the manufacturing progression may start with a patterned hard mask rather than a patterned photoresist. At S320, electroplated metal is plated up through the openings in the patterned sacrificial layer of S310. At S330, the resulting structure following S320 is chemically mechanically polished to obtain uniform thickness for the patterned metal. At S340, a thin dielectric such as silicon nitride is deposited, patterned with the photoresist and etched. The result of S340 is the small strips of dielectric shown in FIG. 3A that hold inner metallic parts in place.

The process from S310, S320 and S330 can be repeated once to obtain the coaxial metallic structure shown for S350. The coaxial metallic structure at S350 is filled in and supported by the photoresist or wet etchable sacrificial material. For a process performed by Microfabrica of Van Nuys, Calif., the sacrificial layer may be a wet etchable metal layer. For a "polystrata" process performed by Nuvotronics of Durham, N.C., the sacrificial layer may be polymer based. At S360, the sacrificial layer from S350 is wet etched away, leaving the resultant coaxial structure which is the final product of the manufacturing progression in FIG. 3A. The profile of the resultant coaxial structure may be rectangular, and the resultant coaxial structure can be used as a plug connector for an opening 101A when the opening 101A is rectangular. In FIG. 3A, the coaxial metallic structure for S350 and S360 is shown with stacked coaxial structures. The stacked coaxial structures are not required for a plug connector described herein, and a single coaxial structure (i.e., the lower coaxial structures of the coaxial metallic structures for S350 and S360) satisfies requirements for a coaxial plug connector described herein.

Using a process from FIG. 3A, a plug connector can be manufactured as an alternative to using conventional coaxial cable. The process of FIG. 3A may be used to manufacture a cylindrical plug connector, but in FIGS. 3A, 3B and 3C the resultant plug connector is a form of 3D patterned or 3D printed plug connector. The resultant coaxial structure from the manufacturing progression in FIG. 3A may have a profile that is rectangular or even square. The resultant coaxial structure may be a 3D metal structure that provides for mode free operation well above 110 GHz, due to small dimensions and dimensional control from the lithography and wafer processing processes. In other words, the resultant coaxial structure in FIG. 3A may be a 3D multi-layer structure formed by micro-forming processes. In embodiments, the process may include adding an electrically thin resistive layer or layers to suppress higher order modes, enabling making the resultant coaxial structures larger and more mechanically robust.

In an embodiment, a micro-formed coaxial signal transmission line can be micro-formed by a process as in FIG. 3A. Such a micro-formed coaxial transmission conductor can be placed inside of the enclosure 100, to form an impedance matched transition between internal circuitry and circuitry outside the wall of the enclosure 100 at the opening 101A. The electrical plug connector 150A is placed in the opening 101A and is mated to the micro-formed coaxial signal transmission line inside of the enclosure 100. A similar connection can be made to another signal transmission line outside of the enclosure 100.

Figure 3B:
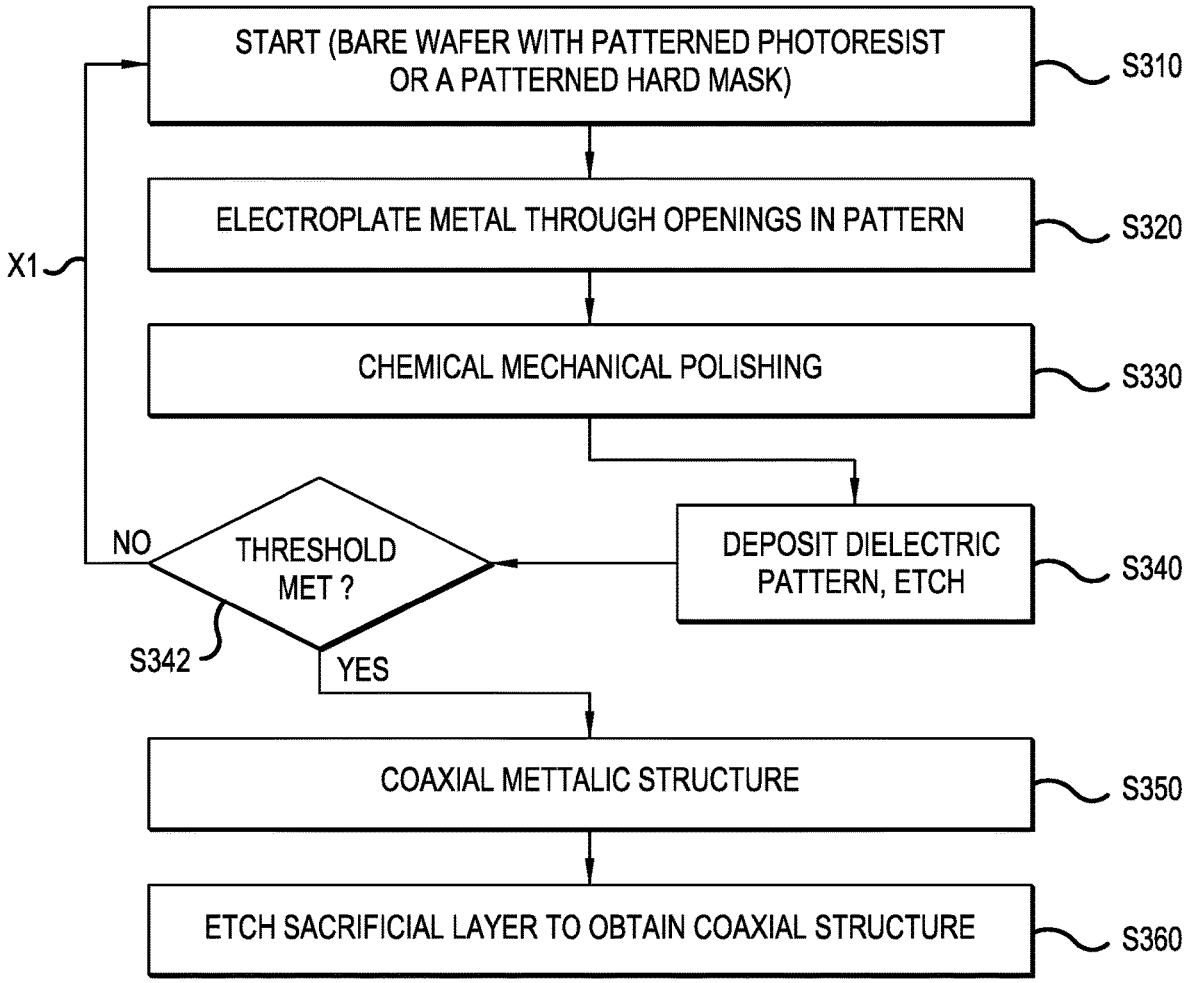
FIG. 3B is an illustrative view of a process corresponding to the manufacturing progression in FIG. 3A, in accordance with a representative embodiment.

FIG. 3B is an illustrative view of a process corresponding to the manufacturing progression in FIG. 3A, in accordance with a representative embodiment.

In FIG. 3B, the process starts with S310. At S310, the process starts with a bare wafer with a patterned photoresist or a patterned hard mask. At S320, metal is electroplated through openings in the patterned photoresist or patterned hard marks. At S330, chemical mechanical polishing is performed. At S340, dielectric is deposited, patterned and etched. At S342, a determination is made as to whether a threshold is reached. The threshold corresponds to the number of times the process from S310 to S330 or S310 to S340 will be performed, which in turn corresponds to the number of layers that will be assembled in the manufacturing process. If the threshold is not yet met (S342=No), the process returns to S310, and if the process is met (S342=Yes), the process proceeds to S350. In FIG. 3B, the process from S310 to S330 or S310 to S340 is performed one additional time, and this is designated by X1 in the flow from S342 to S310. At S350, the result of the processing from S310 to S342 is a coaxial metallic structure with a sacrificial layer. At S360, the sacrificial layer is etched to obtain the final coaxial structure.

Figure 3C:
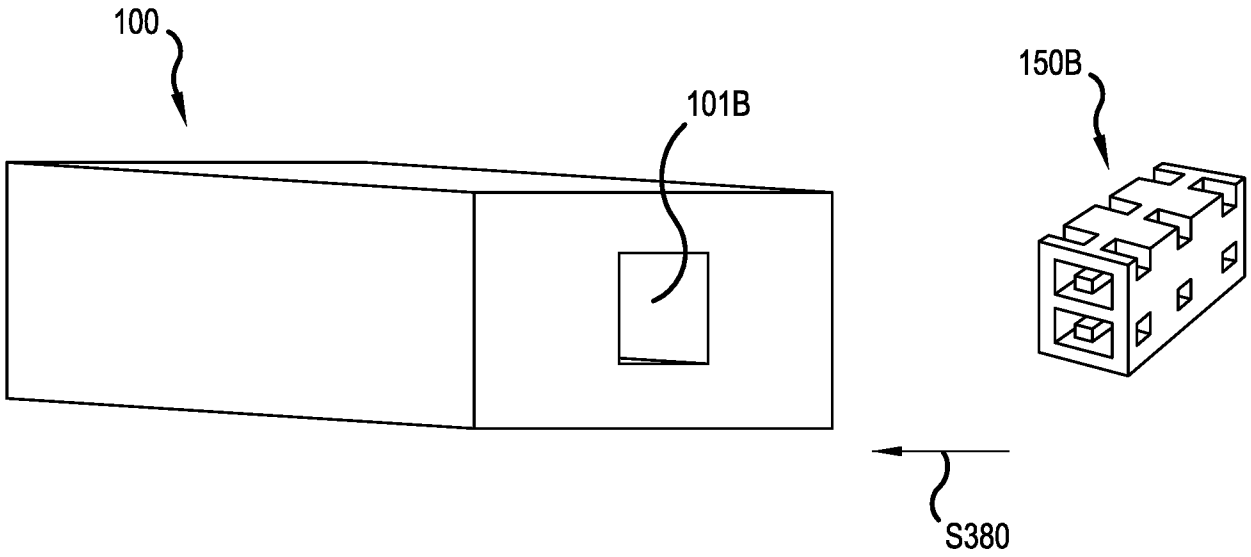
FIG. 3C is an illustrative hybrid view of an enclosure with an opening and an electrical plug connector, in accordance with a representative embodiment.

FIG. 3C is an illustrative hybrid view of an enclosure with an opening and an electrical plug connector, in accordance with a representative embodiment.

In FIG. 3C, an enclosure 100 has an opening in which a coaxial structure built using the manufacturing progression of FIG. 3A can be placed. The coaxial structure 150B shown in FIG. 3C can be a plug connector fixed in place in the opening of the enclosure 100 using mechanisms such as those shown in FIGS. 2A, 2B, 2C and/or 2D.

Figure 4:
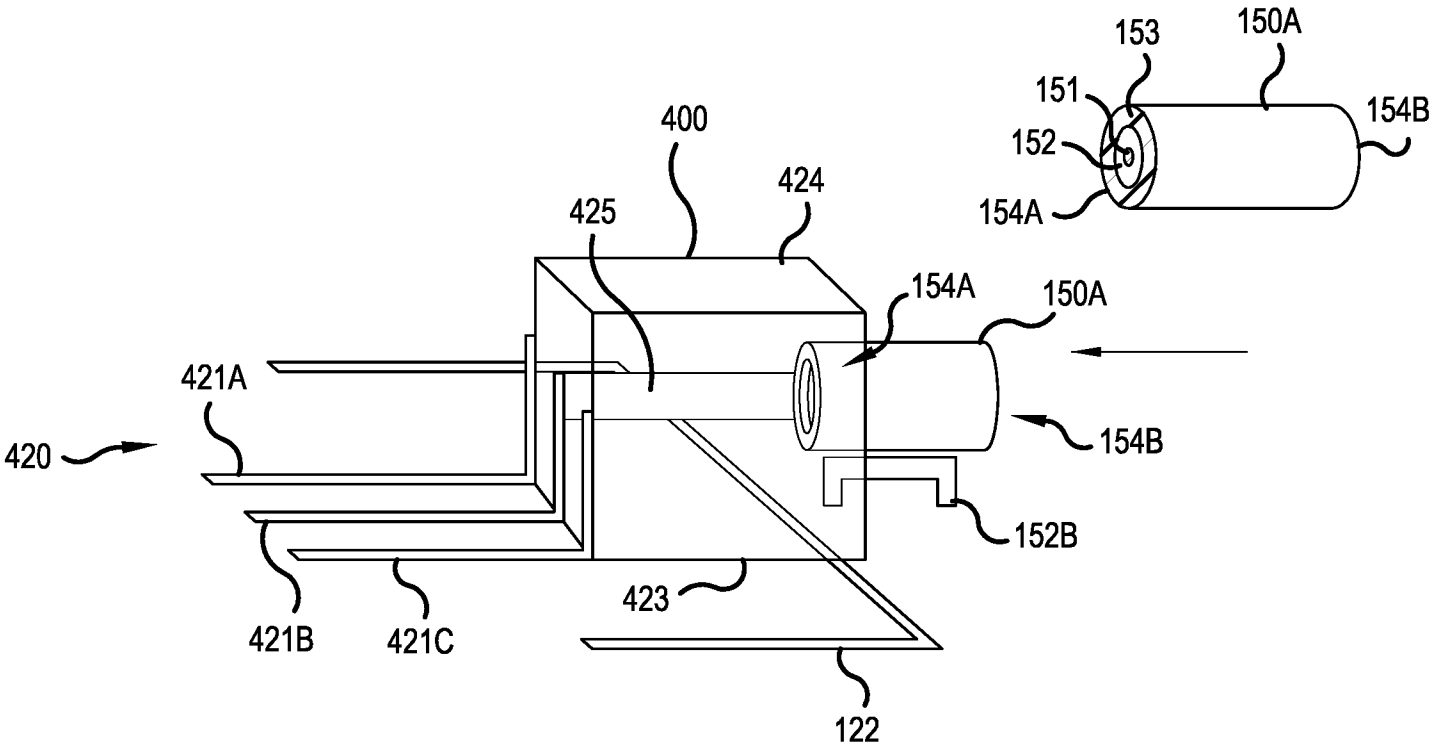
FIG. 4 is an illustrative perspective view of another enclosure with an opening, a co-planar waveguide and another electrical plug connector, in accordance with a representative embodiment.

FIG. 4 is an illustrative perspective view of another enclosure with an opening, a co-planar waveguide and another electrical plug connector, in accordance with a representative embodiment.

In FIG. 4, ground trace 421A and ground trace 421C are elements of a co-planar waveguide 420. The co-planar waveguide 420 carries signals from key circuits housed in an enclosure 400. A signal trace 421B carries signals from the co-planar waveguide 420 inside of the enclosure 400 to electrical plug connector 150A, which is connected to a coaxial cable (not shown in FIG. 4).

The co-planar waveguide 420 is supported on a substrate 422. Example materials for the substrate 422 include fused silica, alumina, or sapphire. The outer ground 423 of the co-planar waveguide 420 connects the ground traces 421A and 421C, with the walls of the enclosure 400 as well as to the outer electrical conductor 153 of the electrical plug connector 150A. A top conductor 424 in FIG. 4 may be representative of a top, sides, and a bottom of a coaxial structure, such as an enclosure 400 that encloses a signal line 425 of the co-planar waveguide 420. The signal line 425 of the co-planar waveguide 420 connects the signal trace 421B of the co-planar waveguide 420 to the inner electrical conductor 151 of the outer electrical conductor 152A at the first outer connector plane 154A. The ground trace 421A and the ground trace 421C connect to ground connections of the top conductor 424, and then to the outer ground conductor of the electrical plug connector 150A at the first outer connector plane 154A. A combined signal line may include the signal trace 421B and the signal line 425. Impedance is controlled by the distance of the combined signal line to all nearby ground conductors on the top and sides, including to the top conductor 424. The electrical plug connector 150A connects to the co-planar waveguide 420 at the first outer connector plane 154A inside the enclosure 400 and to an external signal transmission line, e.g., a coaxial cable, outside of the enclosure 400 at a second outer connector plane 154B. The outer electrical conductor 152A may be the outermost portion of the electrical plug connector 150A, and contacts the inner periphery of the opening (not shown in FIG. 4) of the enclosure 400.

Figure 5A:
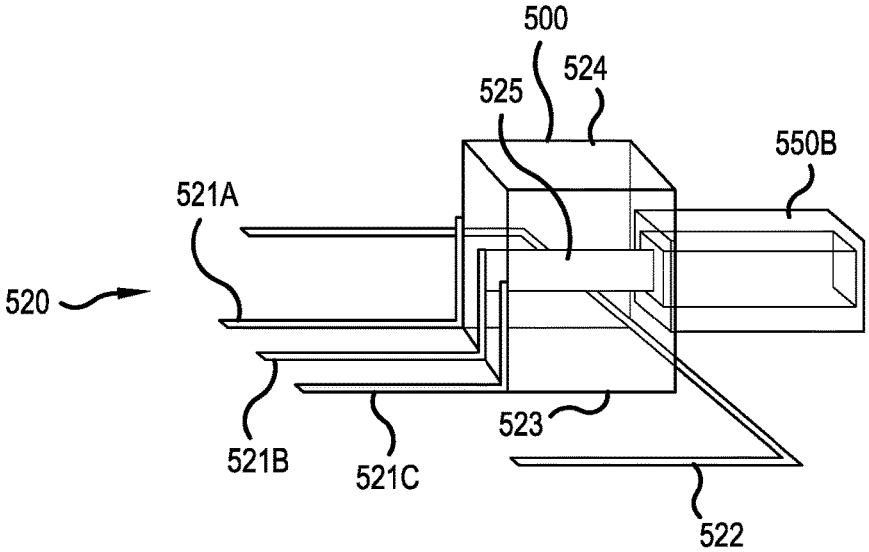
FIG. 5A is an illustrative perspective view of another enclosure with an opening, another co-planar waveguide and another electrical plug connector, in accordance with a representative embodiment.

FIG. 5A is an illustrative perspective view of another enclosure 500 with an opening, another co-planar waveguide and another electrical plug connector, in accordance with a representative embodiment.

In FIG. 5A, the co-planar waveguide 520 includes the ground trace 521A, the ground trace 521C and signal trace 521B. The co-planar waveguide 520 also includes the top conductor 524, the signal line 525, the substrate 522 (e.g., alumina or sapphire) and the outer ground 523. However, in the embodiment of FIG. 5A, the plug connector 550B has a rectangular cross-section (profile) and the opening in the structure (not shown) to connect the plug connector 550B to the co-planar waveguide 520 is also rectangular. Therefore, the plug connector 550B may be made by the microfabrication processes described in FIGS. 3A to 3C. The outer ground 523 couples the ground trace 521A and ground trace 521C of the wave guide to the outer ground conductor of the plug connector 550B at a planar interface between the co-planar waveguide and the plug connector 550B. The signal line 525 connects the signal trace 521B with the center conductor of the plug connector 550B at a planar interface between the co-planar waveguide and the plug connector 550B.

Figure 5B:
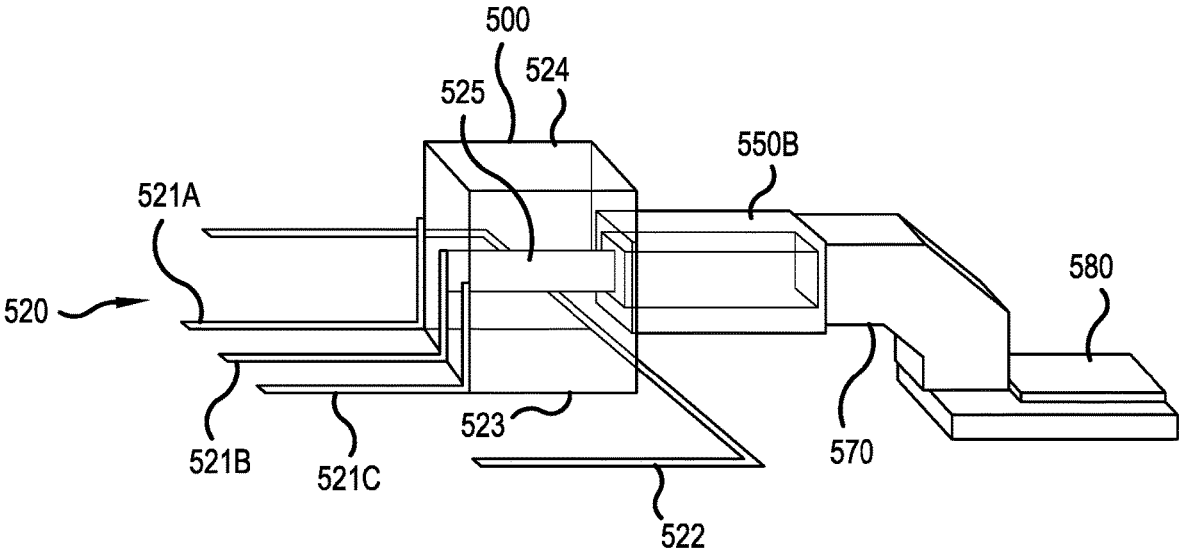
FIG. 5B is an expanded illustrative perspective view of the enclosure with an opening, the co-planar waveguide and the electrical plug connector of FIG. 5A, in accordance with a representative embodiment.

FIG. 5B is an expanded illustrative perspective view of the enclosure 500 with an opening, the co-planar waveguide, and the electrical plug connector of FIG. 5A, in accordance with a representative embodiment.

In the embodiment of FIG. 5B, a thin film circuit 580 is connected via a rectangular coaxial probe 570 to the plug connector 550B at a planar surface on one end outside of an enclosure 500. The thin film circuit 580 may be a co-planar waveguide line on a thin film dielectric such as alumina or sapphire. The plug connector 550B is connected to the co-planar waveguide 520 at a planar surface on the other end. Therefore, the embodiment of FIG. 5B provides full context for an example of how the plug connector 550B can connect a signal transmission line (e.g., rectangular coaxial probe 570) outside of an enclosure 500 to another signal transmission line (e.g., co-planar waveguide 520) inside of the enclosure 500 through an opening 101A. FIG. 5B, therefore shows a connection from the co-planar waveguide 520 in a housing to an external ground-signal-ground probe.

Figure 6:
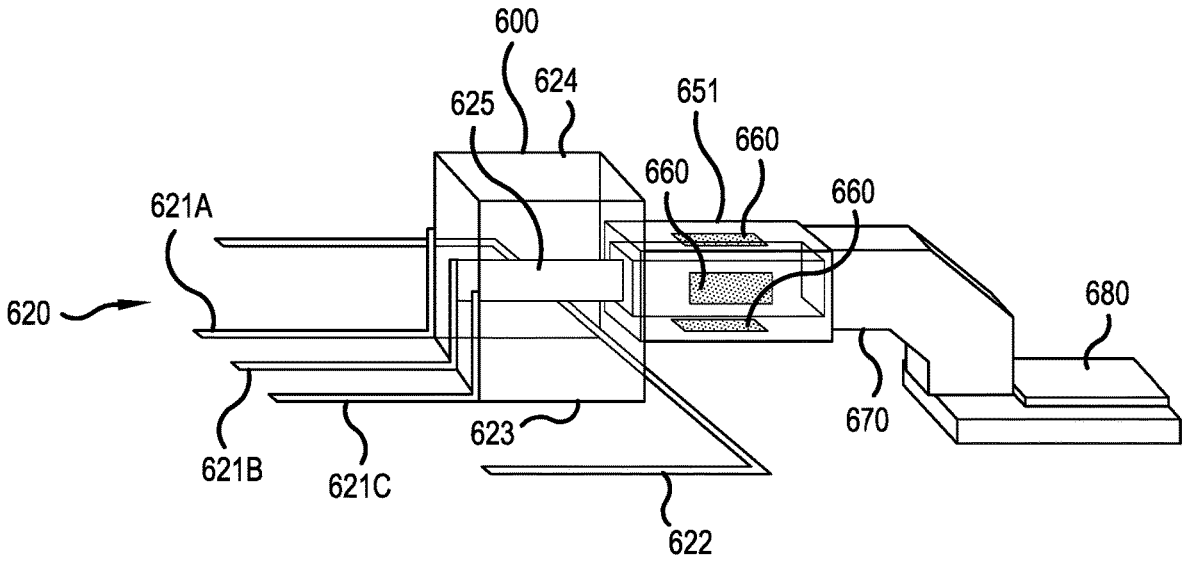
FIG. 6 is an illustrative perspective view of another enclosure with an opening, another co-planar waveguide and another electrical plug connector, in accordance with a representative embodiment.

FIG. 6 is an illustrative perspective view of another enclosure 600 with an opening, another co-planar waveguide and another electrical plug connector, in accordance with a representative embodiment. The representative embodiment depicted in FIG. 6 is substantively similar to the representative embodiment described in connection with FIG. 5B, but with electrically thin resistive layers added to enable larger and more robust plugs for the same (high) frequencies. Therefore, the embodiment of FIG. 6 also shows a connection from the co-planar waveguide 620 in a housing to an external ground-signal-ground probe.

In FIG. 6, electrically thin resistive layers 660 are provided above and below the inner electrical conductor of a plug connector 651. Electrically thin resistive layers 660 that are not shown may also be provided on each side of an inner electrical conductor of a plug connector 651. The electrically thin resistive layers 660 are placed to be perpendicular to the electric field of the mode of interest (TEM mode) for the plug connector. The electrically thin resistive layers 660 will help attenuate higher order modes (e.g. TE11 and TE21) due to their E-fields not being perpendicular to these electrically thin resistive layers 660. The electrically thin resistive layers 660 therefore enable single mode operation with larger, more easily manufactured structures, or operation at higher frequencies for the same geometry size.

The remaining elements of FIG. 6 otherwise correspond to the elements of FIG. 5B, and include a thin film circuit 680 connected via a rectangular coaxial probe 670 to the plug connector at one planar surface. A co-planar waveguide 620 in the enclosure 600 connects to the plug connector at an opposing planar surface.

In FIG. 6, the co-planar waveguide 620 includes a ground trace 621A, a ground trace 621C and a signal trace 621B. The co-planar waveguide 620 also includes a top conductor 624, a signal line 625, a substrate 622 (e.g., alumina or sapphire), and an outer ground 623. The top conductor 624 may be representative of a top, sides, and a bottom of a coaxial structure, such as from the co-planar waveguide 620 to the face of the plug connector 651. The connector in FIG. 6 again has a rectangular cross-section (profile) and the opening in the structure (not shown) to connect the connector to the co-planar waveguide 620 is also rectangular.

Figure 7:
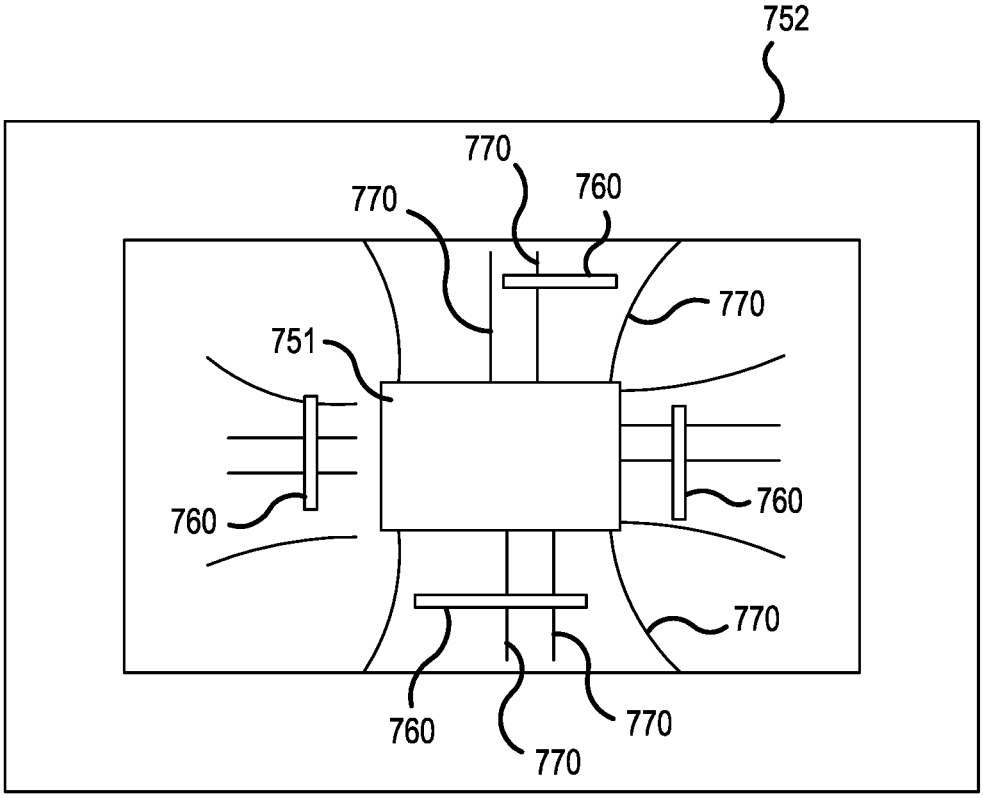
FIG. 7 is an illustrative cross-sectional view of another electrical plug connector, in accordance with a representative embodiment.

FIG. 7 is an illustrative cross-sectional view of another electrical plug connector, in accordance with a representative embodiment.

In FIG. 7, an electrical connector is in the shape of a square or rectangle, and includes an inner conductor 751, an outer conductor 752, and electrically thin resistive layers 760 between the inner conductor 751 and the outer conductor 752. That is, electrical connectors described herein may have cross-sectional profiles that are circles or ellipses in some embodiments, and squares or rectangles in other embodiments such as the embodiment of FIG. 7.

In FIG. 7, the electrically thin resistive layers 760 are non-adjacent to one another, and are formed in a pattern in different planes that are perpendicular to electrical field components of an intended mode. In other words, the electrically thin resistive layers 760 form a pattern of non-adjacent sections. Specifically, in FIG. 7 the electrically thin resistive layers 760 are formed in four different planes or in four different sets of planes where each plane in a set is parallel to each other plane in the set. As a reminder, an intended mode is generally the lowest order mode, and the electric fields of the lowest order mode generally radiate perpendicular to the center conductor. The electrically thin resistive layers 760 are shown above and below and on both sides of the inner conductor 751 for the rectangular coaxial structure. The outer conductor 752 is placed around the inner conductor 751, with the electrically thin resistive layers 760 provided therebetween such as in a dielectric. The electric fields 770 are designated by thin lines from the inner conductor 751, and the electrically thin resistive layers 760 are placed so as to be primarily perpendicular to the electric fields 770 as much as possible.

Figure 8:
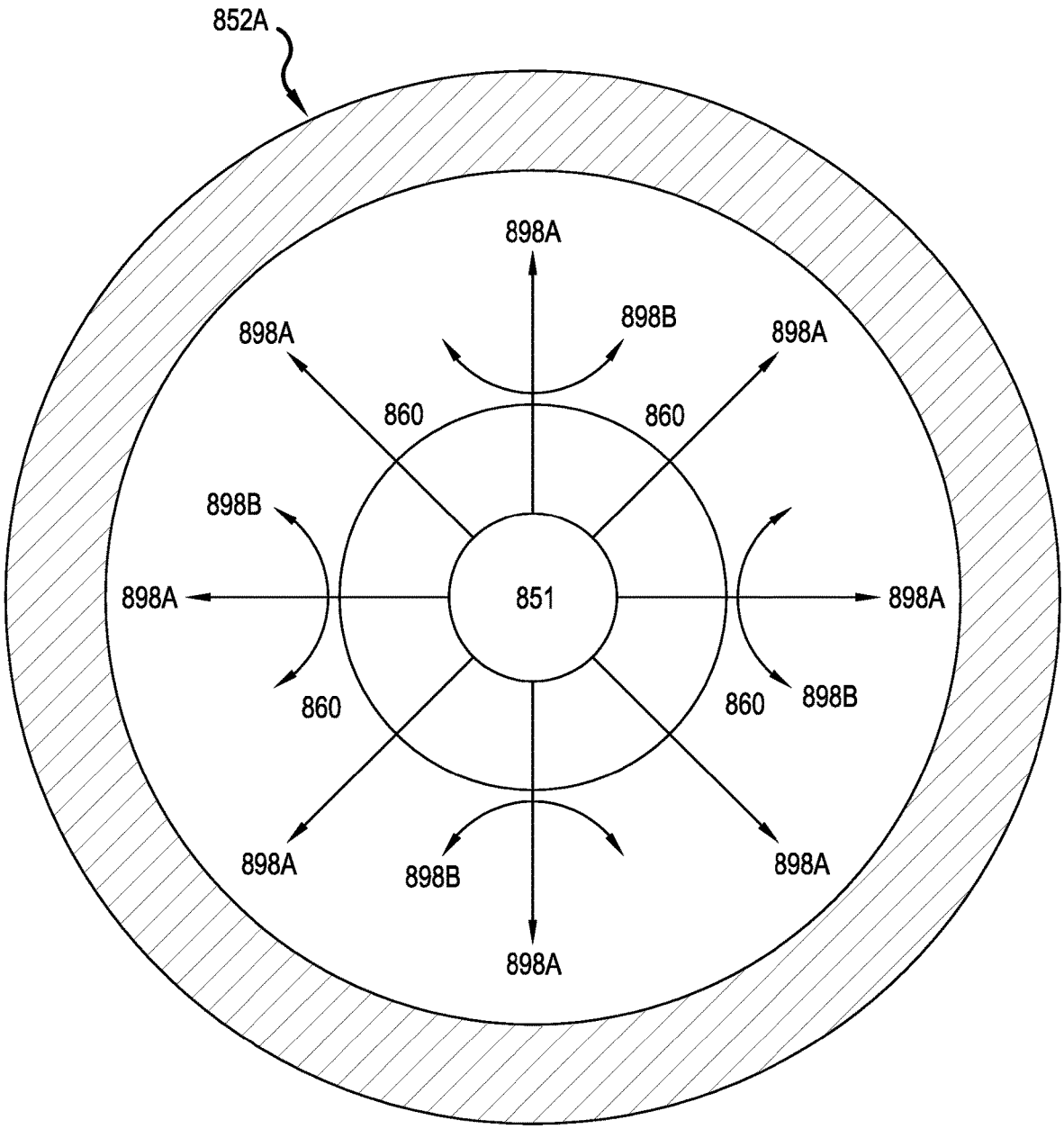
FIG. 8 shows an illustrative cross-sectional view of an electrical plug connector, in accordance with a representative embodiment.

FIG. 8 shows an illustrative cross-sectional view of an electrical plug connector, in accordance with a representative embodiment.

In FIG. 8, an electrically thin resistive layer 860 is embedded in a dielectric between an inner conductor 851 and an outer conductor 852A. The electric fields 898A of the intended primary mode radiate radially from the inner conductor 851, and the electric fields 898B of higher order modes are non-radial. The electrical plug connector in FIG. 8 is coaxial, so the diameter of the electrical plug connector and the dielectric constant of the dielectric material between the inner conductor 851 and outer conductor 852A set the onset of the higher order modes. To make the electrical plug connector in FIG. 8 suitable for frequencies above 110 GHz, the electrically thin resistive layer 860 is provided around the inner conductor. The electrically thin resistive layer 860 substantially attenuates the higher order modes while only minimally impacting the intended primary mode. Accordingly, the electrical plug connector may have a diameter beyond 1 mm. Additionally, the electrical plug connector in FIG. 8 may be provided with one or two faces that are substantially planar in order to mate with one or two signal transmission lines such as coaxial cables.

As set forth above, an electrical plug connector can be fabricated out of a coaxial cable manufactured with an electrically thin resistive sheet placed in a radially symmetric position such as midway from the center conductor to the outer conductor. This enables the electrical plug connector to have a larger diameter, which in turn allows for larger center conductors and larger outer conductors. A larger electrical plug connector structure with the electrically thin resistive layer enables the same plug connector to address a broad range of frequencies, including signals with frequencies above 110 GHz despite the electrical plug connector having a cross-sectional diameter above 1 mm. As noted previously, 110 GHz is itself not an ironclad frequency of interest, but is reflective of an approximate frequency where cables or connectors of a particular diameter propagate a higher order mode that causes interference with a primary mode. Adding the electrically thin resistive layers 660 in FIG. 6 and electrically thin resistive layers 760 in FIG. 7 enables the use of the cable or connector structure above the frequency where the electric fields 898B of the higher order mode would propagate, causing interference with the electric fields 898A of the primary mode.

Accordingly, the electrical plug connector provides faces in planes for mating with signal transmission lines. As noted previously, the mating in planes may be taken to mean that the width of overlap between the coaxial plug connector and a signal transmission line in a plane is minimal compared to the width of coaxial plug connectors. The mating in planes provides for robust, repeatable, and low-cost coaxial plug connectors that avoid use of slotted female and/or slotted male designs.

For example, an electrical plug connector may be provided with a planar (flat) face or a rounded end face, but in the embodiments described herein will not have the standard male/female connections. A replaceable, disposable internal component such as a gasket with two faces may be provided between the faces of the electrical plug connector and the signal transmission line. Additionally, while a multi-layer three-dimensional process can be used to manufacture a multi-layer three-dimensional structure which can be used as an electrical plug connector, an electrical plug connector may also include an internal component made from a conventional semi-rigid coaxial cable. Alternatively, a three-dimensional structure can be created through three-dimensional (3D) manufacturing processes different than those specified herein. Still alternatively, an internal component may be made from high temperature plastic, and may have perforations (holes) to lower the effective dielectric constant so as to match that of a coaxial cable being connected.

Moreover, as noted herein, soft gold or another soft metal may be deposited onto the electrical plug connector faces to enhance the electrical connection. A thin (~10 mil) layer of metal/metals can be added to the surface of the electrical plug connector or cable to prevent wear of such soft gold or other soft metal deposited on the electrical plug connector.

Finally, the electrical plug connector may be provided with a mechanism such as a clamp to ensure a constant compression of the cable ends to the electrical plug connector. Examples include spring loaded sections and metal clips or threads, with mechanical stops to keep from over-tightening/over-compressing a joint of interest.

Although the electrical plug connector has been described with reference to several exemplary embodiments, it is understood that the words that have been used are words of description and illustration, rather than words of limitation. Changes may be made within the purview of the appended claims, as presently stated and as amended, without departing from the scope and spirit of the electrical plug connector in its aspects. Although the electrical plug connector has been described with reference to particular means, materials and embodiments, the electrical plug connector is not intended to be limited to the particulars disclosed; rather the electrical plug connector extends to all functionally equivalent structures, methods, and uses such as are within the scope of the appended claims.

The illustrations of the embodiments described herein are intended to provide a general understanding of the structure of the various embodiments. The illustrations are not intended to serve as a complete description of all of the elements and features of the disclosure described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The preceding description of the disclosed embodiments is provided to enable any person skilled in the art to practice the concepts described in the present disclosure. As such, the above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

The invention claimed is:

1. An apparatus, comprising:

an electrical connector configured to electrically couple a signal transmission line to another signal transmission line, the electrical connector comprising: an inner electrical conductor; an outer electrical conductor; and a dielectric region between the inner electrical conductor and the outer electrical conductor, the dielectric region and the outer electrical conductor being disposed concentrically around the inner electrical conductor, wherein faces on opposing ends of the electrical connector along a center axis are configured to mate the signal transmission line and the outer electrical conductor in a first plane and the other signal transmission line and the outer electrical conductor in a second plane;

an enclosure which encloses the signal transmission line, and which electrically isolates radio frequency (RF) signals from the other signal transmission line;

an outer end osure and an electrically thin resistive layer disposed between the inner electrical conductor and the outer electrical conductor.

2. The apparatus of claim 1, wherein the electrical connector is configured to physically pass through an opening in a radio frequency enclosure.

3. The apparatus of claim 2, wherein the electrical connector is configured to be fixed in place in the opening in the radio frequency enclosure.

4. The apparatus of claim 1, wherein the electrical connector is configured to be fixed in an opening through the enclosure.

5. The apparatus of claim 1, wherein the electrically thin resistive layer comprises a pattern of non-adjacent sections substantially formed in a plurality of different planes and perpendicular to electrical field components of an intended mode.

6. The apparatus of claim 1, wherein a cross-sectional profile of the electrical connector is a rectangle or a square.

7. The apparatus of claim 1, wherein a cross-sectional profile of the electrical connector is an ellipse or a circle.

8. The apparatus of claim 1, wherein the faces on the opposing ends of the electrical connector comprise metal.

9. The apparatus of claim 1, wherein the electrical connector is configured to be fixed in place by a fixture fixed to an enclosure.

10. The apparatus of claim 1, wherein one of the signal transmission line and the other signal transmission line comprises a coaxial cable, and the other of the signal transmission line and the other signal transmission line comprises a co-planar waveguide.

11. The apparatus of claim 1, wherein the electrical connector has a cross-sectional diameter greater than 1 millimeter (mm), and the electrical connector is configured to carry signals with frequencies above 110 gigahertz (GHz).

12. An enclosure, comprising:

at least one wall with an opening provided therein and comprising an upper edge and a lower edge;

a roof connected to an upper edge of the at least one wall;

a floor connected to the lower edge of the at least one wall; and an electrical connector configured to electrically couple a signal transmission line inside the enclosure to another signal transmission line outside of the enclosure, the electrical connector comprising: an inner electrical conductor; an outer electrical conductor; a dielectric region between the inner electrical conductor and the outer electrical conductor; and an electrically thin resistive layer disposed between the inner electrical conductor and the outer electrical conductor, the dielectric region and the outer electrical conductor being disposed concentrically around the inner electrical conductor, wherein faces on opposing ends of the electrical connector along a center axis are configured to mate the signal transmission line inside the enclosure and the outer electrical conductor in a first plane and the other signal transmission line outside of the enclosure and the outer electrical conductor in a second plane, wherein the enclosure isolates radio frequency (RF) signals from the other signal transmission line.

13. The enclosure of claim 12, further comprising:

a substrate above the floor; and circuitry on the substrate, wherein the signal transmission line inside the enclosure comprises a transition from the circuitry to the electrical connector.

14. The enclosure of claim 13, wherein the circuitry comprises a co-planar waveguide.

15. The enclosure of claim 13, wherein the electrical connector is interchangeably fixed in place.

16. The enclosure of claim 12, wherein the signal transmission line inside the enclosure comprises a multi-layer three-dimensional structure.

17. The enclosure of claim 12, further comprising:

a clamp that clamps the electrical connector to the signal transmission line and the other signal transmission line.

* * * * *